United States Patent [19]

Murphy

[11] 4,434,579

[45] Mar. 6, 1984

[54] INSULATING STRUCTURE

[76] Inventor: John S. Murphy, 167 Webbers Path, West Yarmouth, Mass. 02673

[21] Appl. No.: 359,949

[22] Filed: Mar. 19, 1982

Related U.S. Application Data

[63] Continuation of Ser. No. 215,806, Dec. 12, 1980, which is a continuation of Ser. No. 44,355, May 31, 1979.

[51] Int. Cl.[3] ..... E05B 65/04

[52] U.S. Cl. ..... 49/63; 49/372

[58] Field of Search ..... 49/62, 63, 141, 372

[56] References Cited

U.S. PATENT DOCUMENTS

| | | | |
|---|---|---|---|
| 1,442,397 | 1/1923 | Gorrani | 49/370 |
| 1,612,249 | 12/1926 | Anderson | 49/372 |
| 1,636,008 | 7/1927 | Miles | 49/372 X |
| 1,983,846 | 12/1934 | Fuller | 49/372 X |
| 2,026,886 | 1/1936 | Goeltz et al. | 49/372 |
| 2,925,859 | 2/1960 | Baker, Jr. | 49/372 X |
| 4,115,953 | 9/1978 | Brosenius | 49/125 |

*Primary Examiner*—Kenneth Downey

*Attorney, Agent, or Firm*—Blodgett & Blodgett

[57] ABSTRACT

Energy saving apparatus for use with a window, including a sheet of insulating material slidable in and out of a rigid envelope built into the wall.

4 Claims, 3 Drawing Figures

INSULATING STRUCTURE

This is a continuation, of application Ser. No. 215,806 filed Dec. 12, 1980 which is a continuation of application Ser. No. 44,355 filed May 31, 1979.

BACKGROUND OF THE INVENTION

From an energy-loss point of view, a window in a building is a mixed blessing. On the one hand, it allows light to enter the building and it provides in most cases an asethetically pleasing view. It even allows heat to enter the building by radiation, particularly when the sun is shining and is directed through the window. On the other hand, however, at nighttime heat radiates from the interior of the building through the window. Furthermore, when the wind is blowing strongly against the window there is a heat loss by convection. It has generally been recognized that many of these problems can be overcome by providing the window with an insert of insulated sheet material which would be removed by day and in place at night. The problem has always been that the insert must be stored in such a way as to be free of damage and so that is does not effect the appearance of the building aesthetically. These and other difficulties experienced with the prior art devices have been obviated in a novel manner by the present invention.

It is, therefore, an outstanding object of the invention to provide an insulating structure for use in the reduction of loss of heat through a window by radiation and convection.

Another object of this invention is the provision of a window insulating structure, including a sheet of low thermal conductivity that can be moved quickly from operative to inoperative condition.

A further object of the present invention is the provision of an insulating structure in which storage does not cause deterioration of the aesthetic appearance of the building.

It is another object of the instant invention to provide an insulating system which can be installed in the building at the time that it is constructed.

A still further object of the invention is the provision of an insulating structure which is simple in construction, which is inexpensive to manufacture, and which is capable of a long life of useful service with a minimum of maintenance.

Another object of the invention is the provision of an insulating panel that slides readily in and out of a recess in the wall because of a cushion of air that forms during the sliding action.

With these and other objects in view, as will be apparent to those skilled in the art, the invention resides in the combination of parts set forth in the specification and covered by the claims appended hereto.

SUMMARY OF THE INVENTION

In general, the invention consists of an insulating system for use with the window of a building. A rigid rectangular envelope, having an opening along one side, is fastened in a wall with the opening located on the window frame. A sheet of insulating material is slidable in the envelope from an inoperative position within the envelope to an operative position substantially outside of the envelope and coextensive with the window.

More specifically, the envelope is made up of two rigid sheets held in spaced parallel relationship by spacing blocks extending around three sides, the opening existing on the side without a spacing block. The insulated sheet is provided with a rigid peripheral frame. The wall of the building is provided with large-size studding, except in the vicinity of the envelope where small-size studding is used that is smaller than the large size studding by an amount equal to the thickness of the envelope. The envelope and the sheet rest tightly enough that movement of the sheet in or out of the envelope causes a flow of air through the gap between them that acts as an air bearing.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
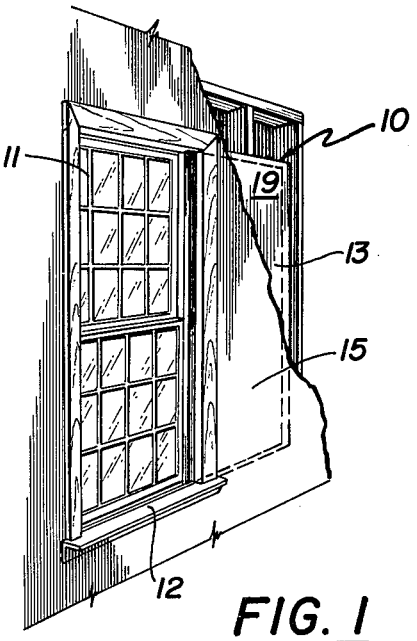
FIG. 1 is a perspective view of an insulating system incorporating the principles of the present invention shown in use with a window in a building.

Referring first to FIG. 1, wherein is best shown the general features of the invention, the insulating structure, indicated generally by the reference numeral 10, is shown in use with a window 11 carried in a frame 12 which is mounted in a wall 15 of a building. The insulating structure includes an envelope 13 mounted in the wall, as will be further described hereinafter.

Figure 3:
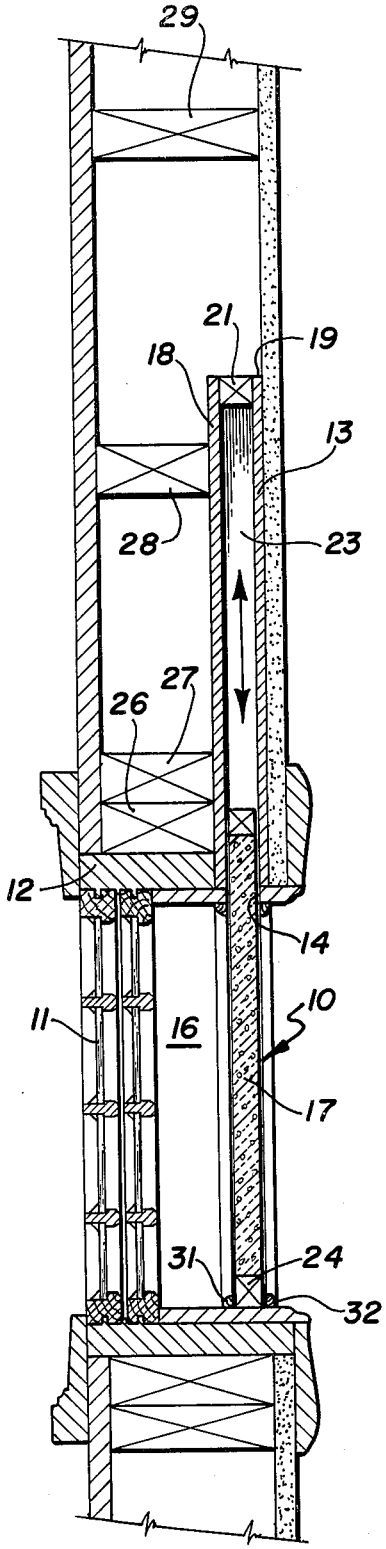
FIG. 3 is a sectional view of the building taken on the line III—III of FIG. 2.
Figure 2:
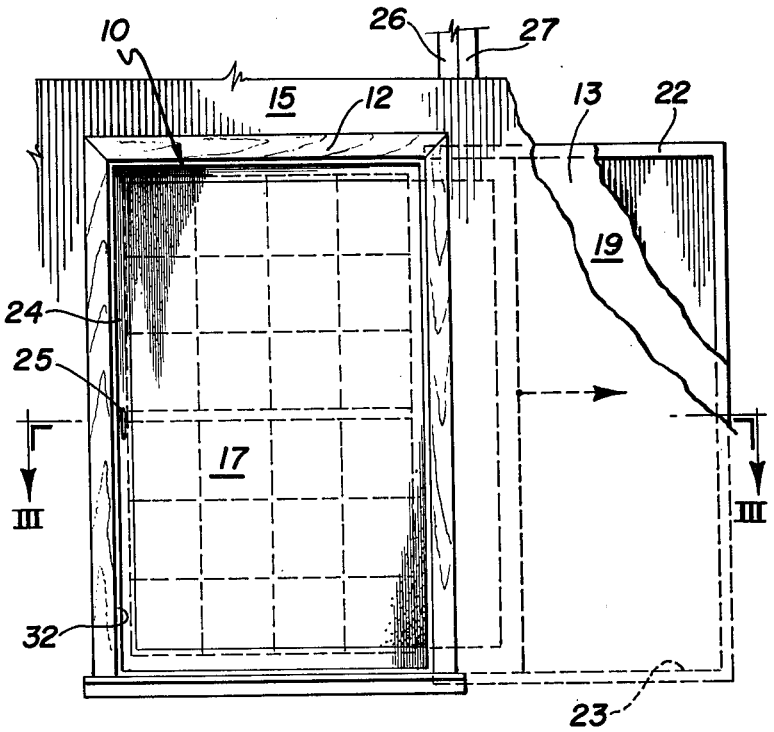
FIG. 2 is a front elevational view of the interior of the window.

FIGS. 2 and 3 show the details of the invention, including the manner in which the envelope is mounted in the wall with an opening 14 exposed to the window opening 16 at a portion thereof located inwardly of the window. The envelope consists of a rigid rectangular container. The fixed sheet 17 of insulating material is slidable in and out of the envelope 13 from an inner position (as illustrated in FIG. 1,) to an operative position co-extensive with the window 11 and entirely filling the frame 12, (as illustrated in FIGS. 2 and 3. )

The envelope 13 consists of two rigid sheets 18 and 19 formed (in the preferred embodiment) of particle board. Both boards are rectangular in shape and are held in spaced parallel relationship by spacer blocks 21, 22, and 23 extending around three of the sides leaving the fourth side free for the opening 14. The sheet 17 is provided with a rigid peripheral frame 24 constructed preferably of wood. The vertical portion of the frame farthest from the opening 14 in the operative position is provided with a hand hold 25. The wall contains three narrow studs 26, 27, and 28 adjacent the window and supporting the envelope 14, while the remainder of the wall uses a wider stud 29. The difference between the width of the wide stud 29 and the narrow studs is exactly the same as the thickness of the envelope. In the preferred embodiment, the narrow studs 26, 27, and 28 are 2×4s, while the wider studs are 2×6s, so that the thickness of the envelope is 2 inches. The arrangement could also use a 2×4 for the stud 29 and a 2×4 on the side for the studs 26 and 28; the envelope 13 would still be 2 inches thick. A pair of beads extends entirely around the frame in the window opening 16 to embrace the edges of the main sheet 17 of insulating material. A bead 31 extends around the edge facing outwardly of the window and a bead 32 extends around the edge facing inwardly of the window. The bead spacing is selected to fit snugly around the edge of the sheet without, of course, inhibiting the sliding movement in or out of the envelope.

The operation and the advantages of the present invention will now be readily understood in view of the above description. When the sheet 17 of insulating material is in "stored" or inoperative position within the envelope 13, the operation and appearance of the window 11 is essentially the same as if the insulating system were not used. The light from the sun passes through the glazing of the window and serves not only to illuminate the room, but also to provide it with solar heat. On the other hand, at night radiation normally takes place from the interior of the room through the window to the outside, thus producing a cooling effect on the interior. In addition, there is a certain degree of leakage around the conventional double-hung window, causing a flow of cold air from the exterior to the interior. This leakage takes place both during the day and during the night and depends to a great extent on the velocity of the wind flowing against the exterior of the building. Nevertheless, since the temperature is usually lower at night, the cooling due to this type of convection leakage has a greater effect in the night time.

In order to render the insulating system operative, it is necessary to slide the sheet 17 out of the opening 14 in the envelope 13 and move it across the window until its peripheral frame 24 lies entirely between the beads 31 and 32. The tight fit of the sheet within the beads reduces the leakage of cold air into the building. More importantly, however, the sheet prevents radiation of heat from the interior of the room through the window to the exterior. In addition, it provides for an insulation of the portion of the building occupied by the window and prevents conduction of heat out of the building. In other words, the use of the present invention reduces the loss of heat due to conduction, convection, and radiation. It can be readily seen that the system is inexpensive in all respects, since it makes use of readily-available materials and is simple in construction. By selecting a suitable ornamentation on the interior and exterior surfaces of the main sheet, the sheet can even improve the interior or the exterior appearance of the house, rather than reduce its attractiveness. By a suitable selection of material and thickness of the main sheet, it is possible to provide a design suitable for any climate and desired effectiveness. As the sheet 17 moves out of the opening 14 in the envelope 13, air flows through the gaps between the sides, bottom edge, and top edge of the sheet and the corresponding surfaces of the opening into the envelope. This flow of air forms a cushion or bearing that allows the sheet to slide easily without the need for expensive rollers or the like. The same air bearing exists when the sheet is pushed into the envelope for storage. The provision for ease of sliding in this way takes advantage of the simplest, maintenance-free structure, which is also the least expensive.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Insulating structure for use with a window which is enclosed within a rectangular window frame which defines a rectangular window opening, said insulating structure comprising:

(a) a rigid rectangular envelope having an opening along one side, the envelope being adapted to being fastened in a wall with the opening facing the window opening, and located in a plane that is offset from the plane of the window, the envelope being substantially air-tight except for the said opening, the envelope consisting of two similar rigid rectangular sheets held in spaced parallel relationship by spacer blocks extending around three side edges, the fourth side edge being free of a spacer block and constituting the said opening, the side of each sheet which faces the interior of the pocket having a flat smooth continuous surface, (b) a main sheet of insulating material slidable in the envelope from an inoperative position in which it is entirely enclosed in the envelope to an operative position in which it is substantially outside the envelope and is co-extensive with the window opening and in front of the window, and (c) a groove which extends entirely around the inside of the window frame except for said opening for receiving the edges of the main sheet when the main sheet lies within said window opening to form a tight seal around the edges of the main sheet.

2. Insulating structure as recited in claim 1, wherein the sheet of insulating material is provided with a rigid peripheral frame, the portion of the frame farthest from the envelope opening in the operative position being provided with a hand hold.

3. Insulating structure as recited in claim 2 wherein the wall is provided with narrow studs adjacent the window to support the envelope and wide studs elsewhere, the difference between the widths of the studs being the same as the thickness of the envelope.

4. Insulating structure as recited in claim 1, wherein said groove is formed by a pair of spaced parallel beads which extend around the window frame.

* * * * *